US006601656B2

(12) United States Patent
Hopper et al.

(10) Patent No.: US 6,601,656 B2
(45) Date of Patent: Aug. 5, 2003

(54) METHOD AND APPARATUS FOR DRILLING AN OFFSHORE UNDERWATER WELL

(75) Inventors: Hans Paul Hopper, Whiterashes (GB); David Garnham, Rothwell (GB)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 10/174,116

(22) Filed: Jun. 18, 2002

(65) Prior Publication Data

US 2002/0157866 A1 Oct. 31, 2002

Related U.S. Application Data

(62) Division of application No. 09/275,346, filed on Mar. 24, 1999, now Pat. No. 6,497,286.

(30) Foreign Application Priority Data

Mar. 27, 1998 (EP) ..... 98302386

(51) Int. Cl.[7] ..... E21B 43/017
(52) U.S. Cl. ..... 175/5; 166/338; 166/359
(58) Field of Search ..... 175/5, 70, 9, 10; 166/335, 338, 339, 341, 358, 359

(56) References Cited

U.S. PATENT DOCUMENTS

| | | | | | |
|---|---|---|---|---|---|
| 3,880,105 | A | * | 4/1975 | Bryant | 114/230.2 |
| 3,885,623 | A | | 5/1975 | Watkins et al. | 166/5 |
| 4,030,310 | A | | 6/1977 | Schirtzinger | 61/86 |
| 4,147,221 | A | * | 4/1979 | Ilfrey et al. | 166/339 |
| 4,326,595 | A | | 4/1982 | Burns | 175/9 |
| 4,462,717 | A | | 7/1984 | Falcimaigne | 405/195 |
| 4,545,437 | A | * | 10/1985 | Denison | 166/345 |
| 4,591,295 | A | * | 5/1986 | Collipp | 175/7 |
| 4,695,189 | A | | 9/1987 | Wallace | 405/169 |
| RE32,623 | E | | 3/1988 | Marshall et al. | 175/9 |
| 4,730,677 | A | * | 3/1988 | Pearce et al. | 166/345 |
| 4,754,817 | A | * | 7/1988 | Goldsmith | 166/353 |
| 4,793,737 | A | * | 12/1988 | Shotbolt | 166/343 |
| 5,697,447 | A | | 12/1997 | Børseth | 166/366 |
| 5,702,205 | A | | 12/1997 | Mahone et al. | 405/169 |

FOREIGN PATENT DOCUMENTS

| | | | |
|---|---|---|---|
| GB | 2 148 842 | 5/1995 | B67D/5/68 |
| GB | 2 307 929 | 11/1997 | E21B/17/01 |

OTHER PUBLICATIONS

1998–99 Cameron Catalog; selected pages; Mar. 1998; (17 p.).

*Through–Flowline (TFL) Equipment*; Otis (undated) (p.240).

Winton, Jack; *Use of Multi–Lateral Wells to Access marginal Resrvoirs*; Offshore; Feb. 1999; (3 p.).

Jee, T. et al; *The Use of Sccrewed Flowlines in Deepwater*; DOT Conference 1993; Nov. 18, 1998; (16 p.).

* cited by examiner

*Primary Examiner*—David Bagnell
*Assistant Examiner*—John Kreck
(74) *Attorney, Agent, or Firm*—Conley Rose, P.C.

(57) ABSTRACT

A method of drilling an offshore underwater well comprising the steps of installing a riser conduit so that it is substantially vertically supported at a production deck. The riser conduit deviates progressively further from the vertical with increasing sea depth, so that its end can be anchored at the seabed by a skid either at an oblique angle so that drilling into the seabed can be carried out at the oblique angle, or horizontally, so that the riser conduit can extend some considerable distance across the seabed before drilling is carried out.

6 Claims, 10 Drawing Sheets

METHOD AND APPARATUS FOR DRILLING AN OFFSHORE UNDERWATER WELL

CROSS-REFERENCE TO RELATED APPLICATION

This is a divisional application of U.S. patent application Ser. No. 09/275,346, filed Mar. 24, 1999 and entitled "Method and Apparatus for Drilling an Offshore Underwater Well," now U.S. Pat. No. 6,497,286 which claims the benefit of 35 U.S.C. 119(a) of EP Serial No. 98302386.2 filed Mar. 27, 1998, and entitled "Method And Apparatus For Drilling An Offshore Underwater Well", both hereby incorporated herein by reference.

STATEMENT REGARDING FEDERALLY SPONSORED RESEARCH OR DEVELOPMENT

None.

BACKGROUND OF THE INVENTION

The present invention relates to a method and apparatus for drilling an offshore underwater well.

Two conventional methods exist for drilling an offshore underwater well. The first of these is to drill and set a conductor pipe between a surface platform and the sea bed followed by drilling a surface well using a platform wellhead. The BOP is located on the surface wellhead. Subsequent casing strings are landed in the surface wellhead. The well is completed by suspending completion tubing from the wellhead and installing a platform tree. A second method is to drill and set a conductor pipe into the seabed using a floating drilling vessel with the wellhead located on the seabed. A subsea drilling BOP has to run on a drilling riser down to the seabed and is connected to the subsea wellhead. A subsea well is drilled with subsequent casing hangers landed in the subsea wellhead. The well is completed by placing a conventional tree on the seabed wellhead. An alternative subsea option is to use a horizontal tree and then run the tubing.

As the industry moves further offshore and beyond the continental shelf, the water depths being considered are drastically increasing as reservoirs down the flank of the continental shelf and on the ocean floors are discovered. These water depths rule out the use of conventional platforms and their low cost drilling techniques. Floating or tension production platform systems can be used but their drilling footprint into the reservoir is limited, requiring peripheral seabed subsea production support wells. Subsea fields involve considerable complex subsea architecture and require extensive high cost rig intervention.

One way in which an attempt has been made to increase the footprint of a production platform is the provision of a slanted conductor. In such an arrangement, the conductor is supported at an angle by the platform so that it can be run in at an angle thereby increasing the lateral distance between the base of the platform and the location where the conductor meets the seabed. However, such an arrangement is awkward and costly as it requires a specially made structure to support the conductor at an angle. Further, the system will not work in deep water without some support for the conductor at various locations between the surface and the seabed, which is not available from a floating platform.

SUMMARY OF THE INVENTION

According to the present invention, a method of drilling an offshore underwater well comprises the steps of installing a riser conduit so that it is substantially vertically supported at a production deck situated substantially at the sea surface and deviates progressively further from the vertical with increasing sea depth, fixing the riser conduit at the seabed in a non-vertical orientation, and drilling the well into the seabed at an angle to the vertical.

As the riser conduit is substantially vertically supported at the production deck, it is possible to use conventional platform drilling and production techniques which help keep the costs to a minimum. Further, because the riser conduit is supported at the surface and at the seabed, and deviates progressively further from the vertical in between, intermediate support is not required but can be provided if necessary by buoyancy modules.

In some fields, the reservoir could be relatively close to the seabed. In such a case, there is insufficient depth for a conventional subsea well which starts vertically at the seabed to be deviated to a sufficient angle to access reservoir formations not already being drained by nearby vertical or deviated wells. Therefore only a limited reservoir acreage can be accessed. With the present invention, some of this deviation from the vertical is already provided before reaching the seabed, so that less deviation is required underground which allows higher angle or horizontal wells to be drilled far along the reservoir. This allows better access to reservoirs which are close to the seabed. However, the most important benefit of the present invention arises when the water is sufficiently deep that the riser conduit can be deviated to be horizontal at the seabed. Once the riser conduit becomes horizontal, it is possible to extend it some considerable distance along the seabed before drilling into the seabed so that the drilling footprint of a platform can be greatly increased without drilling.

There are a number of different ways in which the riser conduit can be installed. According to a first method, the riser conduit is run from an installation vessel with a skid attached, installed vertically and pivotally connected at the seabed, the installation vessel is moved horizontally to the production installation while the riser conduit is fed out from the installation vessel, and the riser conduit is transferred to the production installation. According to a second method, the production deck is offset from the location where the riser conduit is connected to a skid and is to be fixed at the seabed, the riser conduit is connected to a skid and is fed down from the production deck and is maneuvered out to the end target location at the seabed. According to a third method the riser conduit is pre-made and towed to the appropriate location before being fixed at the production deck and fixed at the seabed. In this third case, the pipe may be towed out just off the seabed, and one end raised to the production deck. Alternatively, the pipe may be towed out and hung off at the platform before being lowered to the seabed and fixed.

According to a second aspect of the present invention, an offshore wellhead assembly comprises a production deck at which a riser conduit is vertically suspended, the riser conduit deviating progressively further from the vertical with increasing sea depth, the riser conduit being fixed at an angle to the vertical at the seabed by a fixture, and a cased well extending into the seabed from the fixture.

This arrangement provides the same advantages of being able to access reservoirs areas close to the seabed, and increase the drilling footprint of the production installation as referred to above.

The riser conduit may be rigidly locked to the fixture. However, in order to provide ease of installation and a fixture which can accommodate the riser at any angle it is preferable for the riser conduit to be pivotally attached to the fixture.

The fixture is preferably in the form of a skid having a gravity base or piles to secure it to the seabed. The skid is readily able to be transported to the correct location and can be simply secured to the seabed by the base or the piles.

BRIEF DESCRIPTION OF THE DRAWINGS

Examples of methods and assemblies in accordance with the present invention will now be described with reference to the accompanying drawings, in which.

DESCRIPTION OF THE PREFERRED EMBODIMENT

Figure 1:
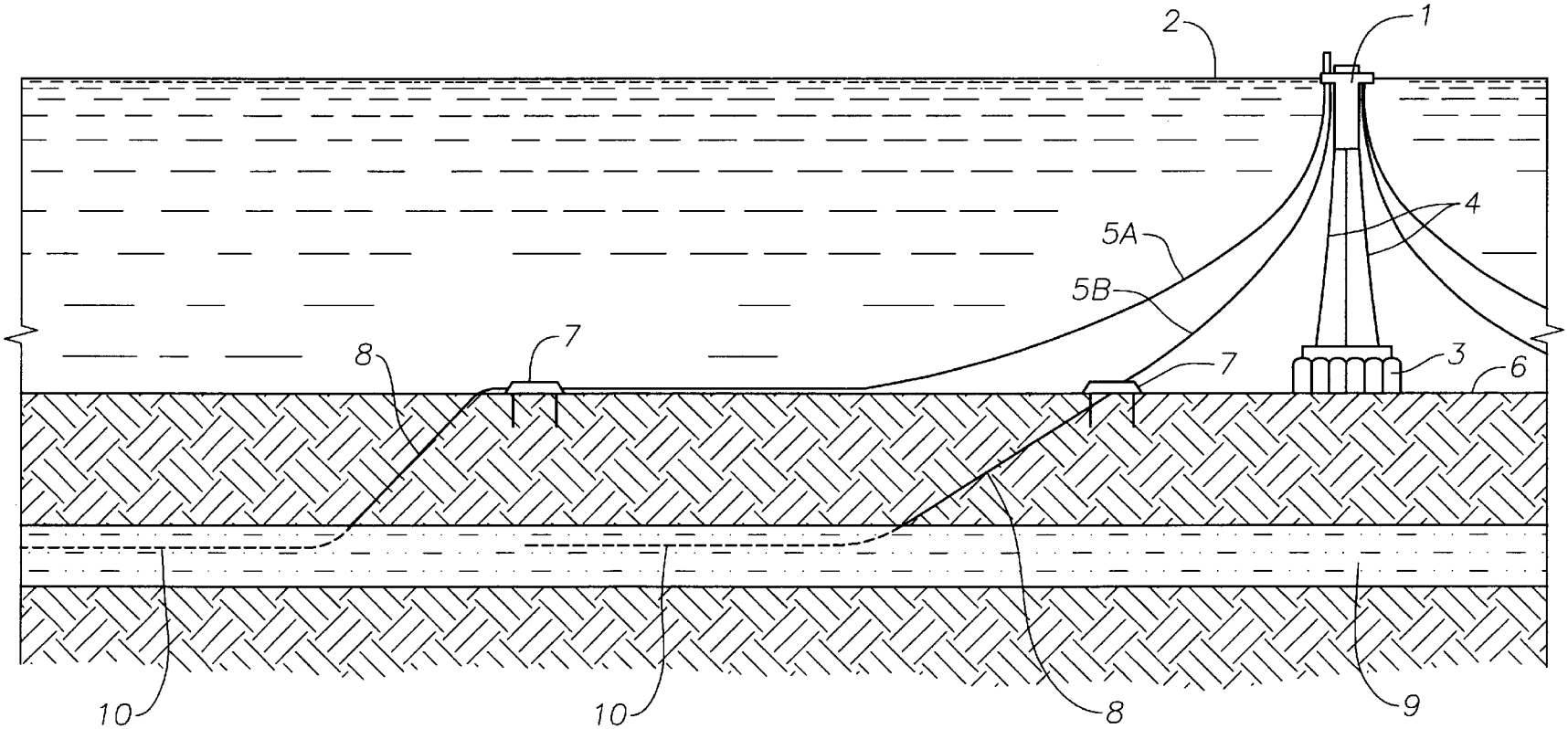
FIG. 1 is a schematic view of an assembly according to a first example.

FIG. 1 shows an example of a tension leg production installation 1 which is shown at the sea surface and is anchored to an optional gravity storage base 3 by mooring legs 4. From the production installation a number of riser conduits 5A, 5B are suspended initially vertically, but deviating progressively from the vertical with increasing sea depth. The conduit 5A has sufficient curvature that by the time it reaches the seabed 6 it is horizontal and can extend a significant horizontal distance along the seabed. At the desired location, the conduit 5A terminates at a skid 7 from which a cased well 8 extends towards the production reservoir 9 where a liner or screen 10 can be positioned. The conduit 5B is of similar construction, with the one exception that it is not horizontal at the seabed. Instead, it is fastened at an oblique angle to the skid 7 and the cased well 8 extends at the same angle into the seabed.

The details of the horizontally extending arrangement of conduit 5A are shown in more detail in FIG. 2 and FIGS. 3A–3D and installation of the wellhead assembly will be described with reference to these drawings.

Figure 5:
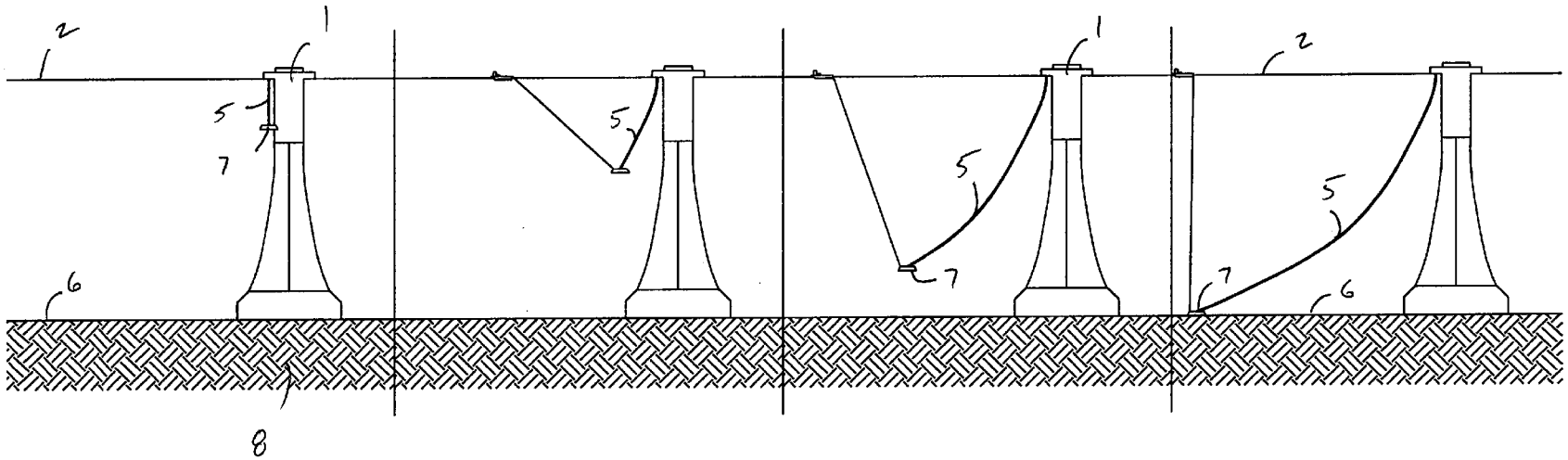
FIG. 5 is an schematic illustration of a first embodiment of the installation of a wellhead assembly.
Figure 6:
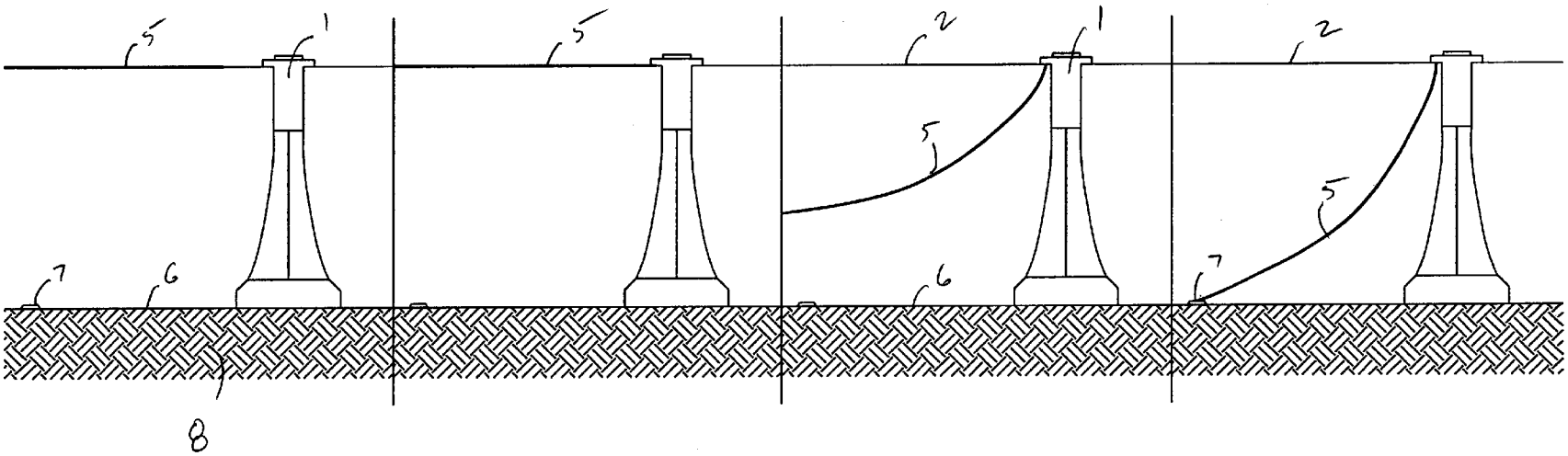
FIG. 6 is a schematic illustration of a second embodiment of the installation of a wellhead assembly.
Figure 7:
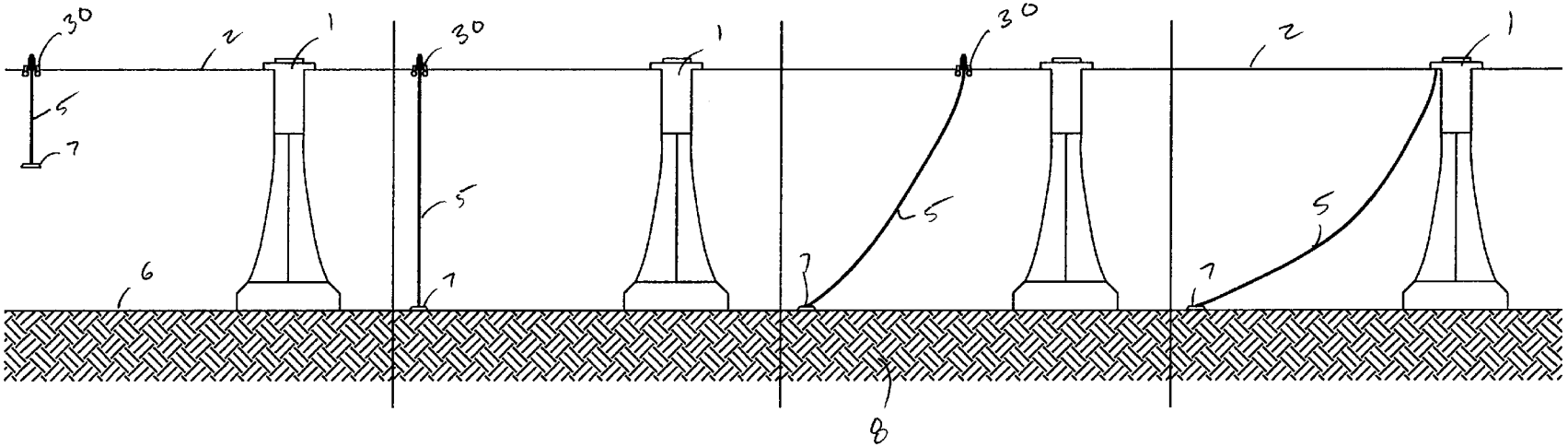
FIG. 7 is a schematic illustration of a third embodiment of the installation of a wellhead assembly.

The first stage of the installation is to install the riser conduit 5, which is, in this particular example, a well riser conduit, from the production installation 1 to the skid 7, which is secured to the seabed 6. This can be done in a number of ways. Firstly, as shown in FIG. 5, the skid 7 can be fixed to the end section of the riser conduit 5 at the production platform 1. The riser conduit 5 is then run vertically from the production platform 1 and is maneuvered out towards the seabed target zone. When correctly positioned, the skid 7 is fixed to the seabed 6. As a second method, as shown in FIG. 6, instead of running the riser conduit 5 vertically from the production installation 1, the riser conduit 5 can be pre-made and can be horizontally towed to the desired location, where it is attached at one end to the production deck 1. The riser conduit 5 is then positioned on the seabed 6 and the skid 7 is fixed to the seabed 6. A third alternative, as shown in FIG. 7, can use an installation vessel 30 instead of a tension leg production installation deck 1 to position the skid 7 and run the drilling riser conduit 5 vertically to attach it to the skid 7 as shown in FIG. 3D, where skid 7 can be pre-installed on the seabed as previously described. The installation vessel 30 can then be moved across to the production platform 1. The end of the riser conduit 5 is transferred from the installation vessel 30 and secured to the production platform 1.

Figure 2:
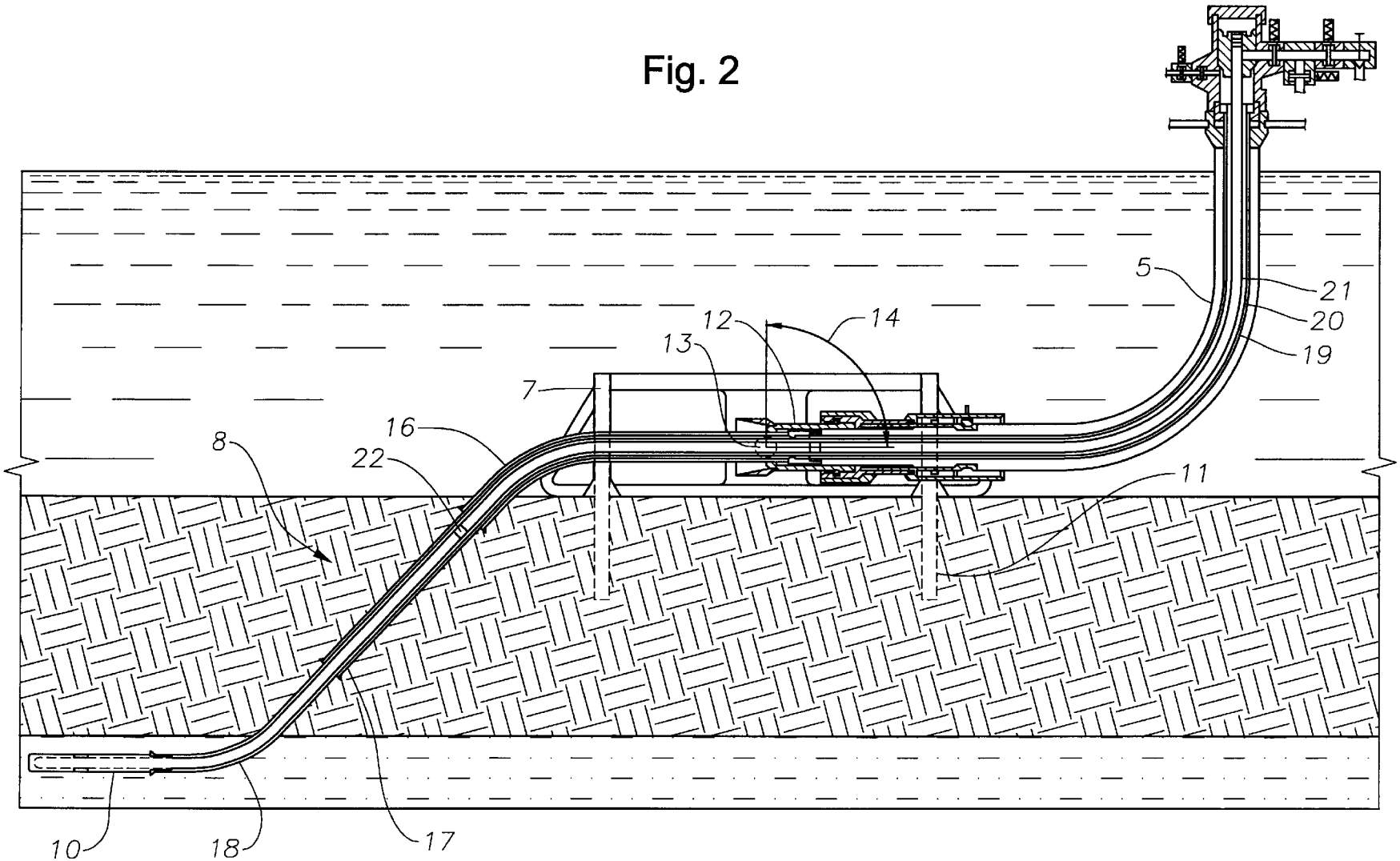
FIG. 2 shows the assembly of FIG. 1 in greater detail.
Figure 3A:
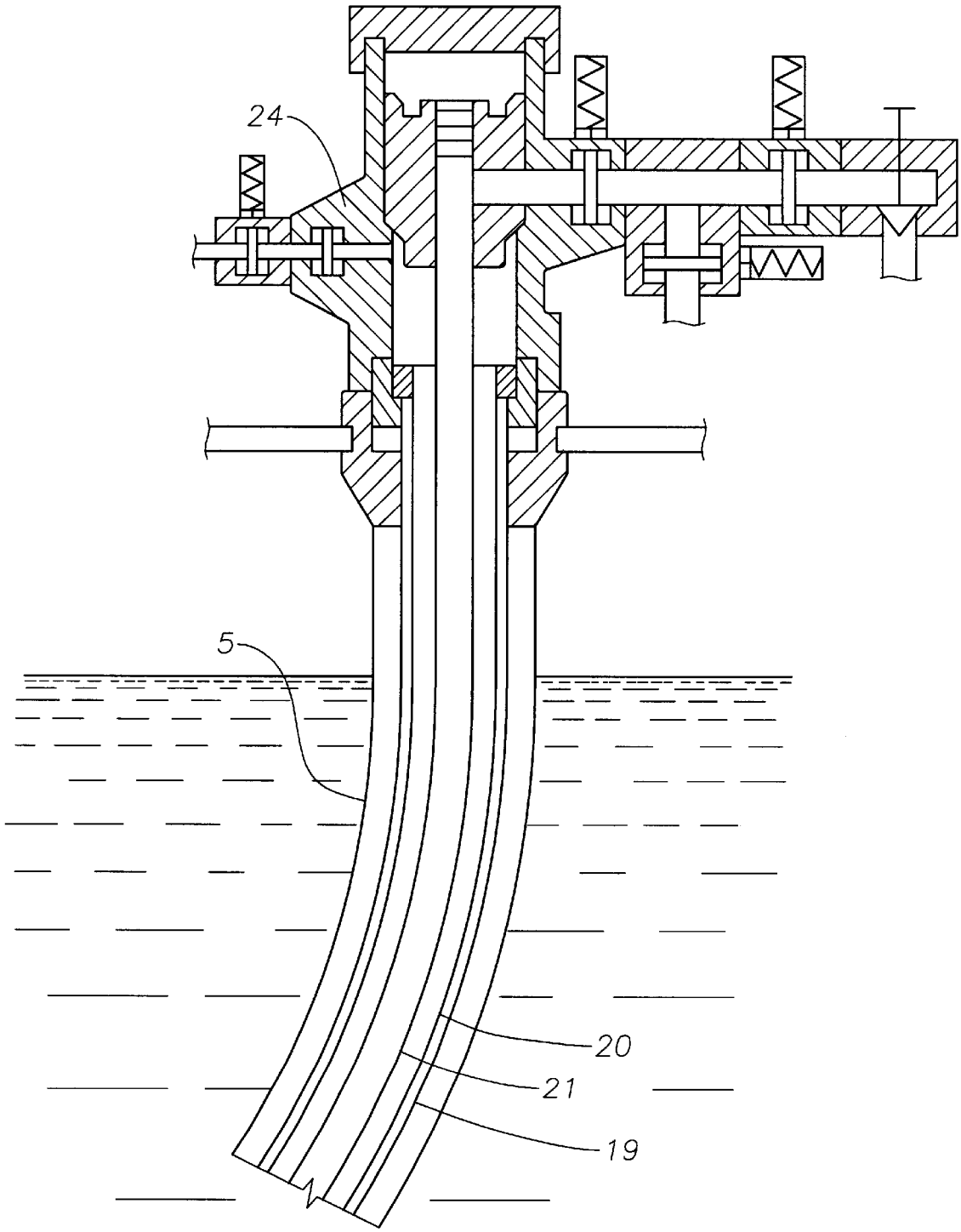
FIGS. 3A–3D show details of elements of FIG. 2.
Figure 3B:
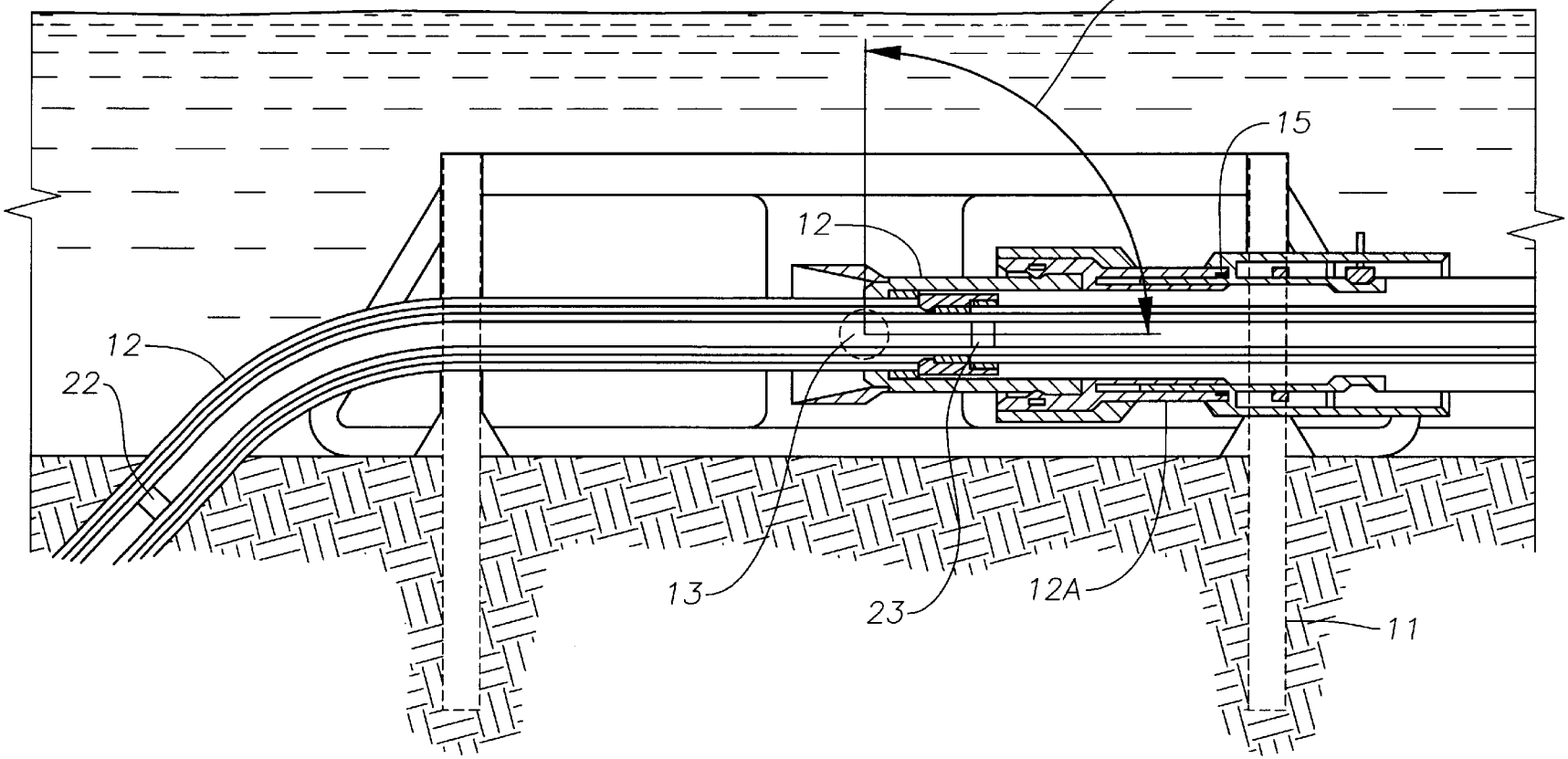
Figure 3C:
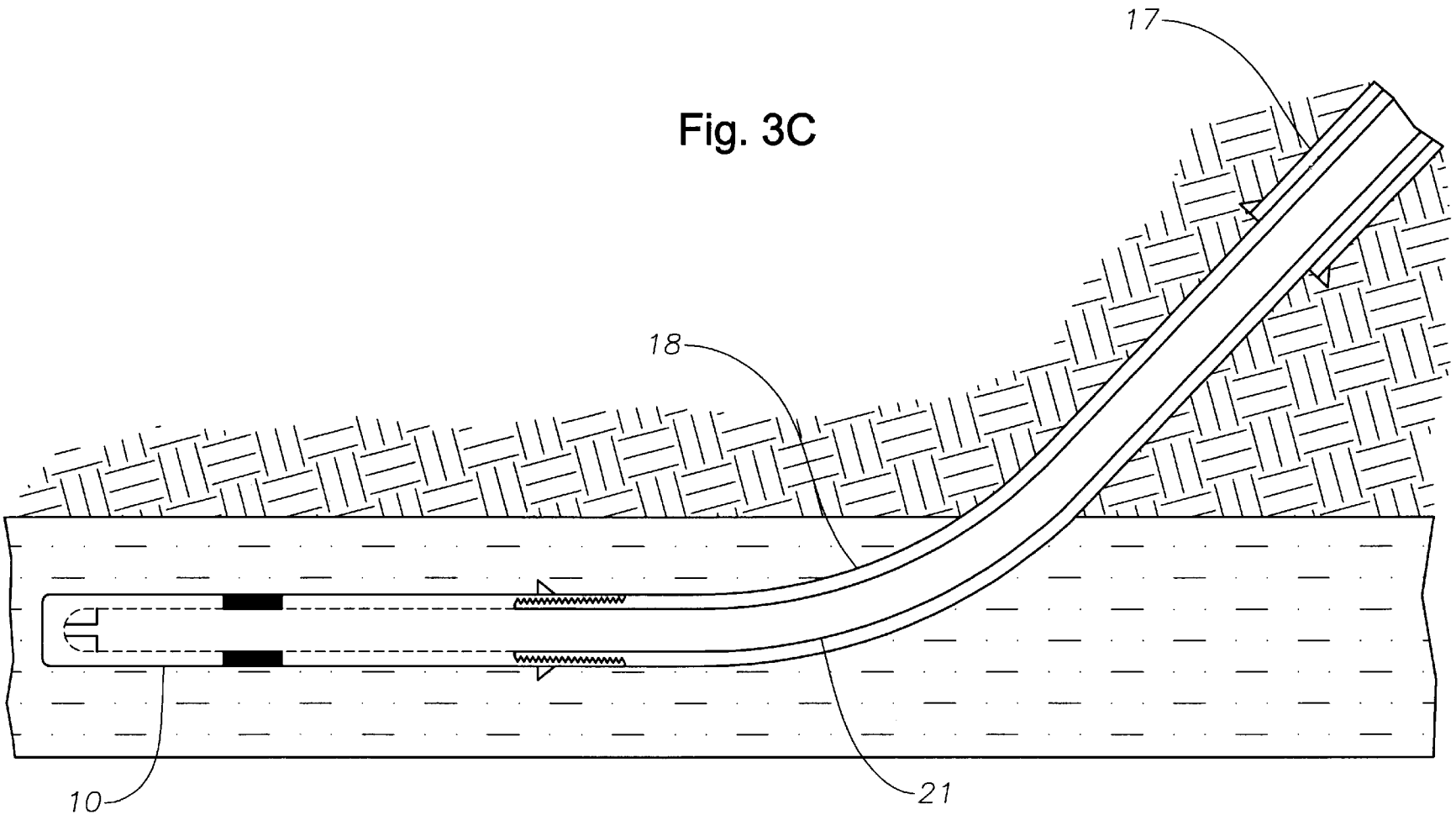
Figure 3D:
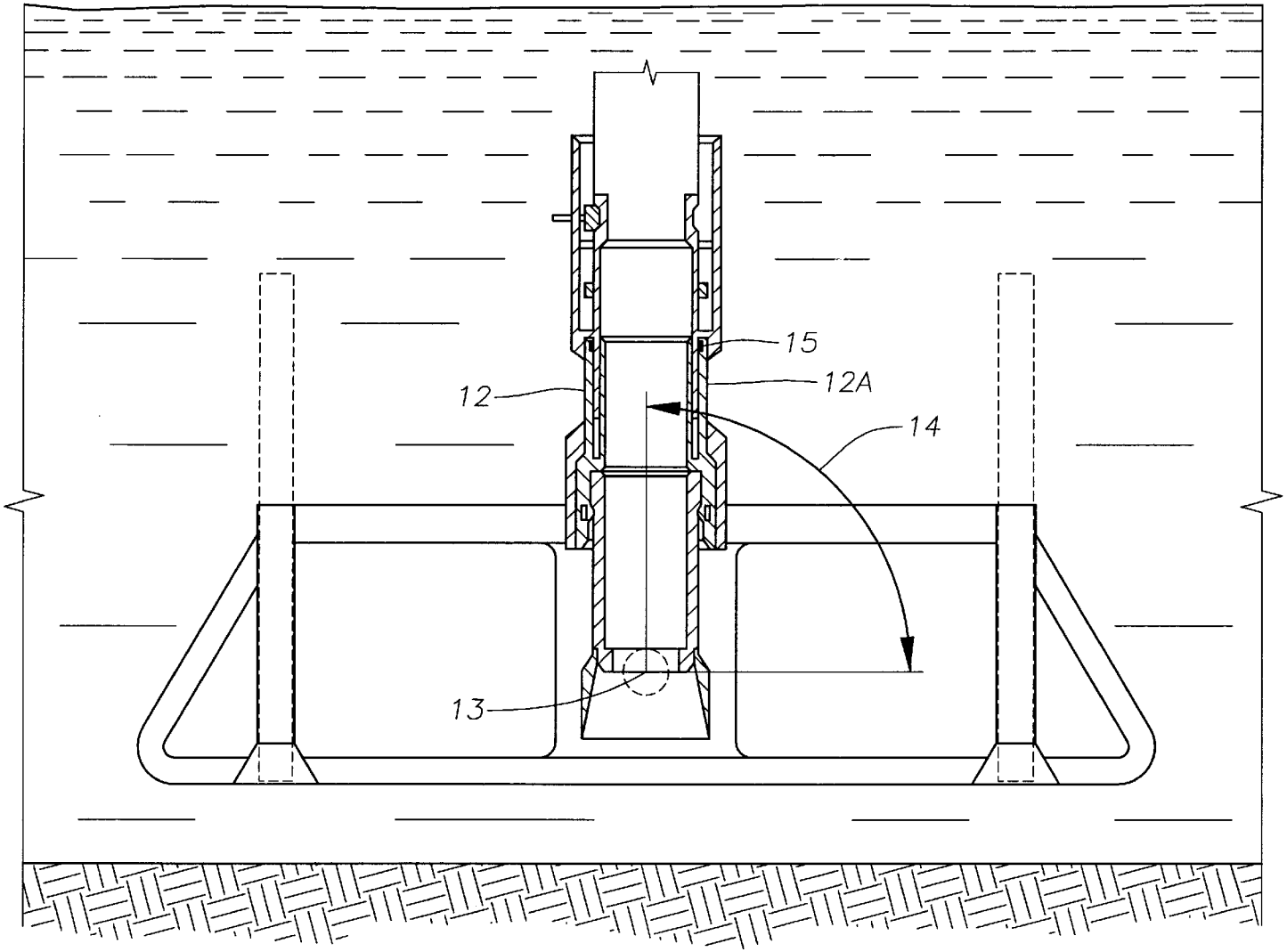

In order to attach the riser conduit to the skid 7, the riser conduit 5 is connected to a wellhead 12, which is held vertically and is pivotally attached to the skid 7, as shown in FIG. 2 and FIG. 3B, about an axis 13 so as to be movable through an angle of 90°, as demonstrated by the arrow 14. The wellhead has a swivel telescopic section 12A, which is locked during the installation process at mid-stroke and is unlocked once the system is installed to allow for riser conduit twist and thermal expansion. This allows not only for the third installation method described. above where the wellhead 12 will initially have to be vertical, but also allows for the oblique riser conduit SE, as illustrated in FIG. 1. The riser conduit 5 is landed within the wellhead 7 and is sealed by pressure seals 15.

The next stage is to drill from the wellhead 12 into the seabed 6 and to install a conductor. Depending on the surface formation a hole can be drilled and a conductor can be installed, or the conductor 16 can be run with an internal shoe bit rotated by a drill string turbine. This latter arrangement can be used in order to drill through unconsolidated formations close to the surface of the seabed so that the conductor 16 supports the formation where a drilled hole would collapse during drilling. In the case of the riser conduit 5B, the conductor 16 will follow the angle of the riser conduit into the seabed, while for the horizontal arrangement, as shown in FIGS. 2 and 3B, the conductor will initially be horizontal but will drop angle under gravity so that it continues obliquely downwardly through the seabed to the desired depth. The conductor 16 is provided with a stop which lands in the wellhead 12 at which point the internal shoe bit is removed and conventional drilling techniques can be used to install a intermediate string 17, a production casing string 18, both of which are landed and sealed within the wellhead 12, and a liner or screens 10.

The drilling elements can be provided with a system of rollers which may be driven in order to facilitate their rotation and passage down the riser conduit. It may even be useful to provide hydraulic force to the drilling or to the casing running systems to provide movement along the riser conduit S, particularly where the riser conduit has a long horizontal portion.

The appropriate tie back casings 19, 20 are hung off at the production deck and landed within the wellhead 12 in a similar manner as for conventional vertical tieback wellheads.

The well completion tubing 21 is now run from the production installation all the way to the production formation. Alternatively, the completion tubing can be hung off in the wellhead 12. The completion tubing can be provided with two surface control safety valves 22, 23.

By using the tie back strings and landing the production tubing in the wellhead 12, it is possible to perform a disconnect operation above the wellhead 12 after the well is made safe. To facilitate reconnection, the skid can have a horizontal pipeline pull in system. Alternatively if it is envisaged that the conductor will never need to be disconnected the intermediate casing string and the production casing string can be run directly up to the production platform without landing in the skid wellhead 12.

At the production deck, a BOP (not shown) is removed and a tree 24 of known construction is installed for production. In this case, a horizontal tree is shown which has the tubing run through it and landed in it.

Figure 4:
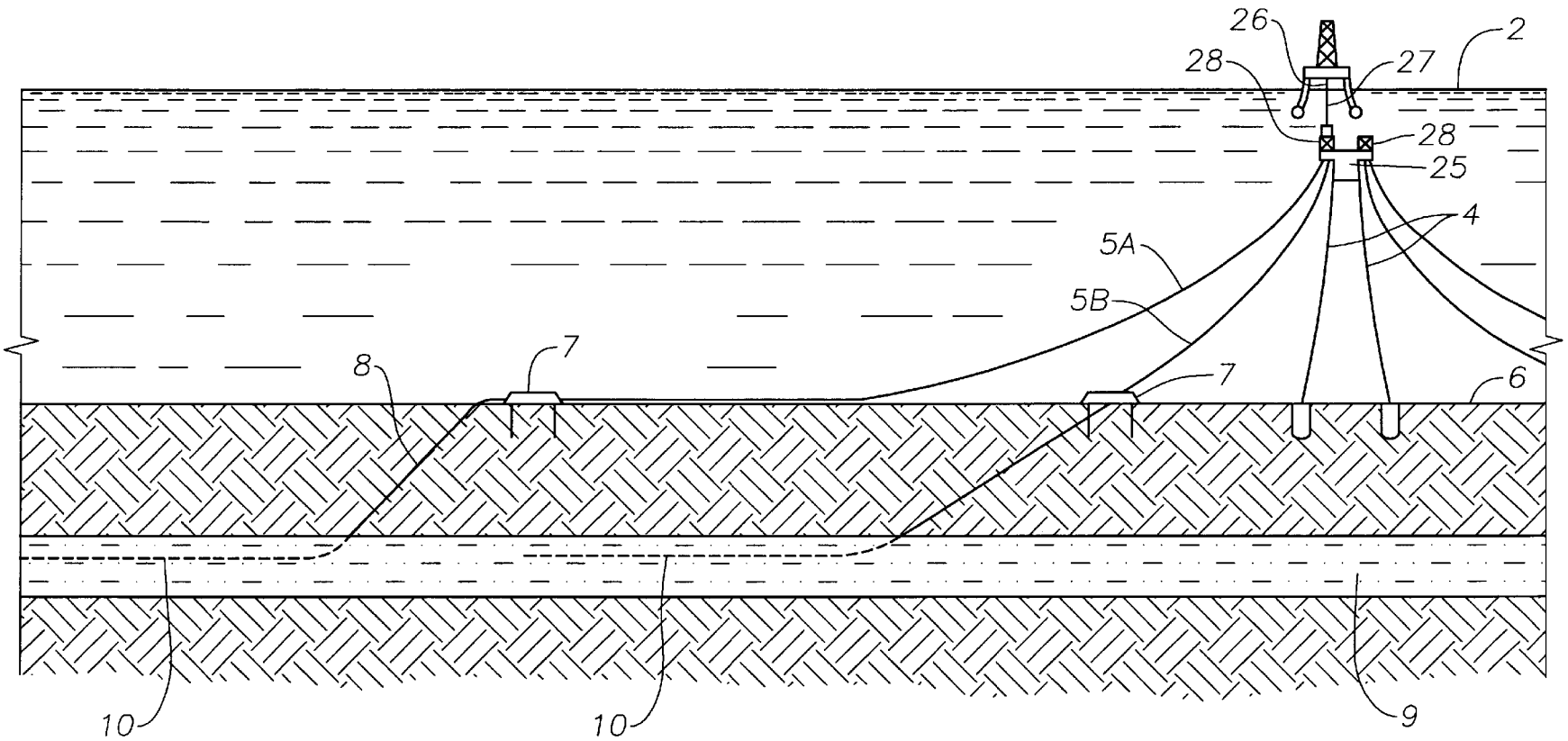
FIG. 4 is a schematic view of a second example.

A second example of an assembly is shown in FIG. 4. The only difference between this assembly and that shown in FIG. 1 relates to the nature of the production installation. Instead of a tension leg production installation at the surface as shown in FIG. 1, the example of FIG. 4 has a tension leg subsurface platform 25 which is positioned at a relatively short distance below the surface 2 and connected to a mobile drilling vessel 26 by a short drilling riser 27. The mobile drilling vessel can be moved between wellheads 28 together with a drilling BOP 29 and can thus be used to drill a number of wells. In this case, the drilling riser is vertical at the subsurface platform 25.

What is claimed is:

1. A method of drilling an offshore underwater well, the method comprising the steps of:

installing a drilling riser conduit so that it is substantially vertically supported at a production deck situated substantially at the sea surface and deviates progressively further from the vertical with increasing sea depth;

fixing the drilling riser conduit at the seabed in a non-vertical orientation remote from the production deck; and drilling the well into the seabed at an angle to the vertical, wherein installing the drilling riser conduit further comprises:

running the drilling conduit vertically from an installation vessel with a skid attached, pivotally connecting the drilling riser conduit at the seabed, moving the installation vessel to the production deck while the riser conduit is fed out from the installation vessel, and transferring the riser conduit to the production deck.

2. A method of drilling an offshore underwater well, the method comprising the steps of:

installing a drilling riser conduit so that it is substantially vertically supported at a production deck situated substantially at the sea surface and deviates progressively further from the vertical with increasing sea depth;

fixing the drilling riser conduit at the seabed in a non-vertical orientation remote from the production deck; and drilling the well into the seabed at an angle to the vertical, wherein the production deck is offset from the end target location where the riser conduit is to be fixed at the seabed, wherein installing the drilling riser conduit further comprises:

connecting the riser conduit to a skid;

feeding the riser conduit down from the production deck; and maneuvering the riser conduit out to the end target location at the seabed.

3. A method of drilling an offshore underwater well, the method comprising the steps of:

installing a drilling riser conduit so that it is substantially vertically supported at a production deck situated substantially at the sea surface and deviates progressively further from the vertical with increasing sea depth;

fixing the drilling riser conduit at the seabed in a non-vertical orientation remote from the production deck; and drilling the well into the seabed at an angle to the vertical, wherein installing the drilling riser conduit further comprises:

pre-assembling the riser conduit;

towing the riser conduit in a horizontal orientation to the appropriate location; and fixing the riser conduit at the production deck.

4. The method of claim 1 wherein the drilling riser conduit is substantially horizontal at the seabed.

5. The method of claim 3 wherein the drilling riser conduit is substantially horizontal at the seabed.

6. The method of claim 5 wherein the drilling riser conduit is substantially horizontal at the seabed.

* * * * *